United States Patent [19]

Card et al.

[11] Patent Number: 4,587,914

[45] Date of Patent: May 13, 1986

[54] TUFTING MACHINE AND METHOD OF PREVENTING SEW THROUGH AND TAGGING IN PRODUCING A TUFTED PRODUCT

[76] Inventors: Roy T. Card, 4012 Creekwood Ter., Chattanooga, Tenn. 37421; Joseph L. Card, 1515 Edgewood Cir., Chattanooga, Tenn. 37405

[21] Appl. No.: 722,507

[22] Filed: Apr. 12, 1985

Related U.S. Application Data

[63] Continuation-in-part of Ser. No. 663,183, Oct. 22, 1984.

[51] Int. Cl.[4] ..... D05C 15/00

[52] U.S. Cl. ..... 112/266.2; 112/79 R

[58] Field of Search ..... 112/79 R, 266.2

[56] References Cited

U.S. PATENT DOCUMENTS

| | | | |
|---|---|---|---|
| 2,975,736 | 3/1961 | Card | 112/79 |
| 3,316,867 | 2/1961 | Erwin, Jr. | 112/79 |
| 4,419,944 | 12/1983 | Passons et al. | 112/79 R |

*Primary Examiner*—Ronald Feldbaum

*Attorney, Agent, or Firm*—Newton, Hopkins & Ormsby

[57] ABSTRACT

A conventional tufting machine is provided with a looper control cam which enables the machine to avoid tagging and sew through. The cam reciprocates loopers which face in the direction of movement of the backing material. Each looper moves beyond the needle as the needle descends, so that the looper bill tip is held beyond the needle as it passes along one side of the loops, then the looper is reciprocated to catch the loop before the needle is retracted.

8 Claims, 14 Drawing Figures

TUFTING MACHINE AND METHOD OF PREVENTING SEW THROUGH AND TAGGING IN PRODUCING A TUFTED PRODUCT

CROSS REFERENCE TO RELATED APPLICATION

This is a continuation-in-part of application Ser. No. 663,183 filed Oct. 22, 1984.

BACKGROUND OF THE INVENTION

1. Field of the Invention:

This invention relates to a tufting machine and method of preventing sew through and tagging in producing a tufted product.

2. Description of the Prior Art:

In the past, tufting machines have been produced which move the bills of the loopers or hooks forwardly beyond the needles so as to hold the loops in position for producing chain stitching. U.S. Pat. No. 4,419,944 typically discloses this type of machine. Our application Ser. No. 663,183 also discloses a tufting machine having loopers or hooks which hold the bights of the preceding loops in forward positions as the needles descend for producing chain stitching. In our co-pending application, the needle passes adjacent to the body of its looper and inwardly of a portion of the held preceding loop, linking one loop to the next.

The term "sew through" as used herein, means sewing a loop through a portion of a proceeding loop. The term tagging, as used herein, is the creating of a proceeding longer loop due to the engaging and pulling of a preceding loop as the needle sews a current loop. The problem of tagging and sew through has been with the tufting industry at least since the tufts have been sewn closely to each other in a longitudinal row. This problem has never been solved in an inexpensive and expeditious way, even though efforts have been made to overcome the problem.

U.S. Pat. No. 3,316,867 discloses a tufting machine with a needle inclined to the bedplate for keeping the preceding loops out of the paths of the needles. U.S. Pat. No. 2,975,736, for example, discloses a loop shedder mechanism for preventing tagging, in which the needles project into rearwardly opening grooves extending downwardly from the bedplate to terminate almost at the tops of the loopers. When the yarn loops are released from the grooves, they cannot get back in the needle paths. These prior art patents disclose quite expensive ways of preventing tagging and sew through.

SUMMARY OF THE INVENTION

Briefly described, the present invention includes a conventional tufting machine having a cam or other control means which provides quick strokes for the loopers and a pause when the loopers are in their protracted or rearward positions across their normal path of the loop. The needles, on each stroke, thus, pass outwardly adjacent to the bills, without the bills grasping the loops; however, upon further insertion of the needles, the loopers are then rapidly retracted and again protracted for engaging and retaining the loops. The loops are then shed in the usual way.

Accordingly, it is an object of the present invention to provide an apparatus and method for readily and easily producing tufts of yarn without appreciable danger of tagging or sew through.

Another object of the present invention is to provide an apparatus for producing a tag free tufted product, in which apparatus is inexpensive to manufacture, durable in structure and efficient in operation.

Another object of the present invention is to provide an inexpensive and efficient method of producing a tufted product which method will assure that none of the preceding loops are tagged or sewn through.

Another object of the present invention is to provide a tufting machine capable of producing a tag free tufted product with the stroke of the loopers being short, and over only a portion of the cycle, thereby reducing vibrations caused by the loopers.

Other objects, features and advantages of the present invention will become apparent from the following description when taken in conjunction with the accompanying drawing when in like characters of reference designate corresponding parts throughout the several views.

DESCRIPTION OF THE PREFERRED EMBODIMENT

Figure 1:
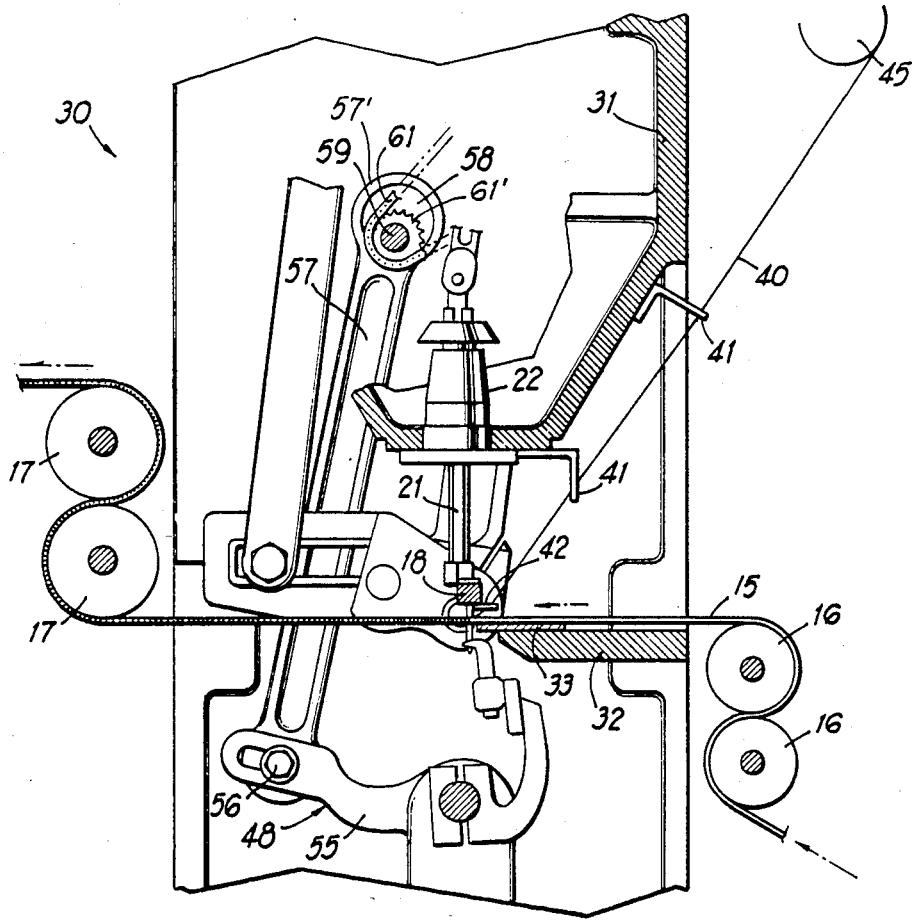
FIG. 1 is a fragmentary vertical sectional view of the portion of a conventional tufting machine which has been modified so as to prevent tagging and sew through, in accordance with the present invention.

Referring now in detail to the embodiment chosen for the purpose of illustrating the present invention, numeral 30 in FIG. 1 denotes generally the tufting machine, including a frame or housing 31 having a bed plate 32 upon which is supported a needle plate 33. The needle plate 33 is adapted to support, in a substantially horizontal plane, the backing material or base fabric 15 which is adapted to be moved by conventional means, such as fabric feed rollers 16 and 17, along a longitudinal linear path of movement, as indicated by the arrow in FIG. 1.

As is conventional, a transversely extending needle bar 18 is disposed above the needle plate 33 and carries a plurality of downward protruding, evenly transversely spaced, needles 20 which are arranged in one or more transverse rows so that the needles 20 are moved from a top dead center, retracted position, free of the backing material 15, down through the backing material 15 in an insertion stroke to bottom dead center and then withdrawn from the backing material 15, in a retraction stroke to top dead center, upon each cycle or reciprocation of the needle bar 18. Thus, the needles 20 are inserted each cycle to a uniform extent through the backing material 15.

Needle bar 18 is reciprocated by a plurality of transversely spaced push rods, such as push rod 21, which are slideably carried in sleeve bearings, such as bearing 22, in the housing 31.

As shown in more detail in U.S. Pat. No. 4,419,944, a chain 61, driven in synchronization with the reciprocation of the needle bar 18, drives a sprocket 61' for rotating a hook or looper drive shaft 59. According to the present invention, this hook or looper drive shaft 59 is rotated one revolution upon one reciprocation or cycle of the needle bar 18.

Yarns 40 are fed through fixed yarn guides 41 and needle bar yarn guides 42 to each of the needles 20, so that a yarn 40 may be carried by an eye 20*a* adjacent to point 20*b* of each corresponding needle 20 as it penetrates the backing material 15 to its lowermost positions to form a yarn loop 44 and then 41*a* etc. in a longitudinal row in backing material 15.

The looper mechanism, denoted generally by the numeral 48, includes a plurality of loopers, such as looper 50, which respectively cooperate with needles 20. Each looper 50 may, if desired, be in the shape and configuration shown in FIGS. 3–7 of U.S. Pat. No. 4,419,944, we have illustrated, however, that each looper 50 include a flat rectangular shank 51 which is mounted in a conventional manner on a hook or looper bar 52 mounted on a rocker arm 53, which, in turn, is clamped to a hook or looper shaft 54. The looper shaft 54 is fixed to and driven by a looper drive lever 55, the free end of lever 55 is slotted for adjustable pivotable connection by a pin 56 to the lower end of connection rod 57. The upper end of connecting rod 57 has a bearing or cam follower 57, which journals the rotary eccentric or cam 58. Cam 58 forms the control means, synchronizing the movement of the needles 20 and loopers 50. Cam 58 is fixed on the looper drive shaft 59. A drive sprocket 61 drives through a sprocket (not shown) the looper drive shaft 58 so that the rocking of the looper drive shaft 59 is synchronized with the reciprocation of the needle bar 18. Thus, each looper 50 is rocked or reciprocated back and forth in a fixed path of travel, upon one reciprocation of the needle 20. According to the present invention, this hook or looper drive shaft 59 is rotated one revolution upon one reciprocation or cycle of the needle bar 18.

Yarn 40 is fed through fixed yarn guides 41 and needle bar yarn guide 42 to each of the needles 20, so that a yarn 40 may be carried by the eye 20*a* of each corresponding needle 20 as it successively penetrates the backing material 15 to its lowermost positions to form successive loops 44, 44*a* with successive increments of yarn inserted through the backing material 15.

Figure 9:
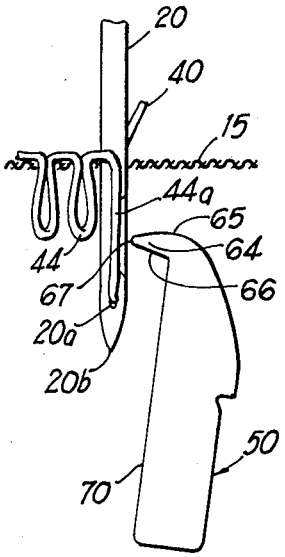

At the upper end of each shank 51 of each looper or hook 50 is a rearwardly facing, rearwardly tapered bill 64 having an upper convex edge 65 and a straight lower edge 66 which generally converge rearwardly to a rounded tip or point 67. Bill 64 is integrally formed with and protrudes in a longitudinal direction rearwardly from the upper end portion of shank 51, the bill 64 being formed as an integral sidewise extension of the shank 51. The top edge portion of the looper 50 may be laterally offset from plate 68, or indented, as illustrated in FIG. 9 of U.S. Pat. No. 4,419,944, if desired. The ball 64 and shank 51 may, if desired, be in a common flat plane. The shank 51 has a straight generally vertically disposed rear edge 70, the upper end portion of which terminates at the edge 66 in a corner, forming an obtuse angle with edge 66.

All loopers 50 face rearwardly in the machine, i.e., i the direction of movement of the backing material 15. This enables the successive loops 14, 44*a* which are collected on the bill 67 to be released or shed by the bill 61, after being held sufficiently for forming the loops.

Figure 3:
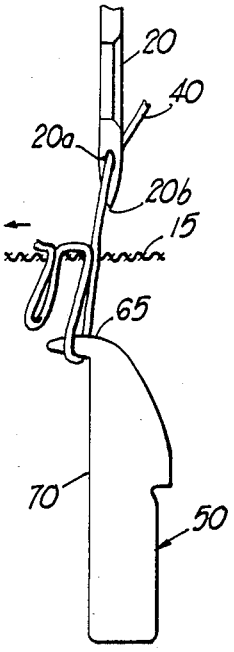
FIGS. 3 through 14, inclusive, are fragmentary side elevational views of a needle and looper, showing successive positions of the needle and looper of the tufting machine of FIG. 1, during a single cycle of the machine.

In operation, the needles 20 sew yarns 40 through the backing material 15 to form transversely spaced rows of successive loops 44, 44*a*, etc. In FIG. 3 through 14, the action of a typical needle 20 and looper 50 in a single cycle of the machine is depicted for producing a single longitudinal row of tufts. In FIGS. 3 through 7, looper 50 is in its rear most protracted position and is at dwell. When the needle 20 has been reciprocated and is retracted to top dead center, as shown in FIG. 3, a loop 44 has been formed in the backing material 15, the bight or extremity of the loop 44 being retained as the backing material 15 is moved rearwardly of the needle path in the direction of the arrow.

Figure 2:
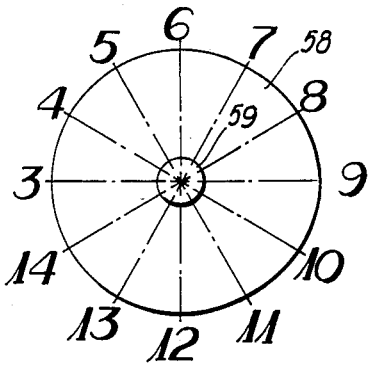
FIG. 2 is an enlarged schematic view of the eccentric or cam utilized by the tufting machine depicted in FIG. 1 for manipulation of the loopers so as to produce the tab free, sew through free, tufted fabric, according to the present invention.

In FIG. 2 is illustrated the cam 58 employed for reciprocating the loopers 50, cam 58 has an eccentric periphery 81 which is journalled by the bearing or cam follower 57. The machine of the present invention, except for cam 58, is conventional, and hence a more detailed description of the linkage between the needles 20 and the loopers 50 is not necessary.

Figure 4:
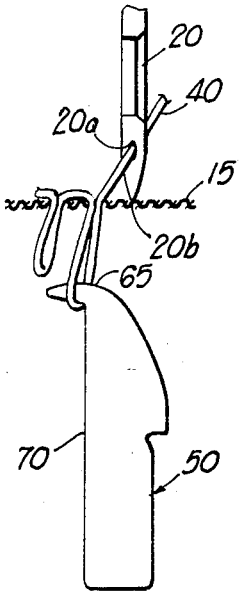
Figure 5:
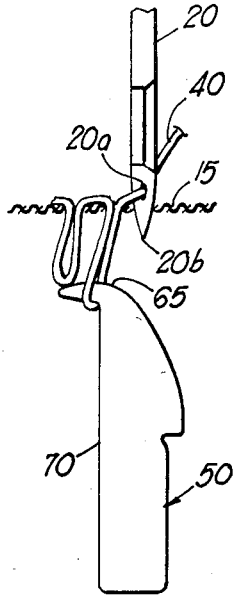
Figure 6:
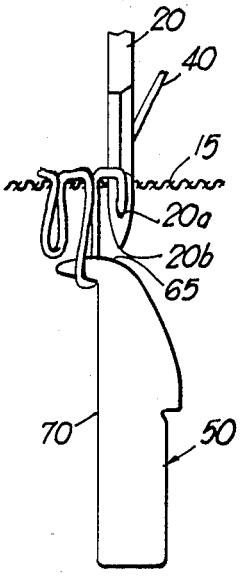

The numerals 3 through 14 around the periphery of cam 58 show the peripheral portions of cam 58 which respectively causes the looper 50 to be in the positions respectively shown in FIGS. 3 through 14. The cam 58 has essentially a uniform circular periphery at positions 3, 4, 5 and 6; thus, the looper 50, in FIGS. 3, 4, 5 and 6, is depicted as stationary or at dwell with the looper bill 64 hold the loop 44. During this period, however, the needle 20 descends from its top dead center or retracted position (FIG. 3) to progressively penetrate backing 15, as shown in FIGS. 4, 5 and 6, and to commence the formation of loop 44*a*.

Figure 7:
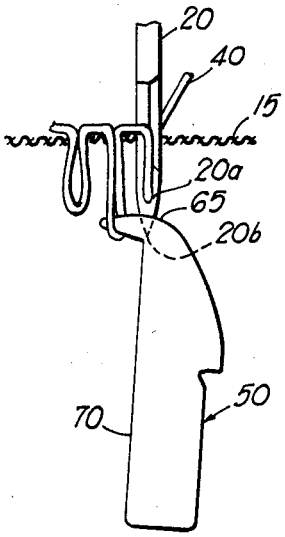

In FIG. 7, it is seen that, as the looper 50 begins to retract from loop 44, point 20*b* of needle 20 has travelled to a position below the upper convex edge 85 of looper 50, passing along one side of bill 64, forwardly of loops 44, without the loop 44*a* being caught by looper bill 64. Thus, the bight of loop 44*a* is confined outside bill 64 and in spaced relationship to the loop 44, the point 20*b* of needle 20 being at about the level of the bight or extremity of loop 44.

Figure 8:
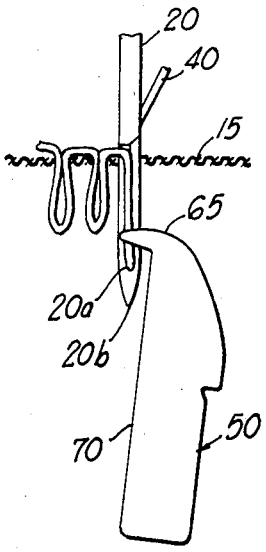

In FIG. 8, it is seen that with further retraction of looper bill 64 and further penetration of the needle 20, two things occur, almost simultaneously. The loop 44 is released and the eye 20*a* of the needle 20 positions the bight or extreme portion of the loop 44*a* below and to one side of bill 64 again without loop 44*a* being caught by the bill 64.

The bill 64, in being retracted, in FIG. 8, wipes across an intermediate portion of loop 44*a* and the bight of loop 44*a* is usually below the bight of loop 44 since there is some robbing of yarn from loop 44 and stretch of loop 44*a* as the back stitch, connecting loops 44, 44*a*, is drawn tight. If, in releasing loop 44, there is any drag on the loop 44 or reluctance for the looper to shed the loop 44, the depth of penetration of the needles 20 is sufficient for the needle 20 to arrest forward movement of the loop 44 and needle 20 causes loop 44 to be wiped from the bill 64. Thus, no tagging or sew through occurs.

At FIG. 9 the looper bill 64 is fully retracted forwardly and is again at dwell with the point 67 of bill 64 now on the front side of needle 20.

Figure 10:
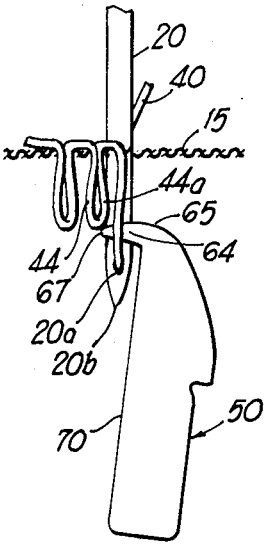

In FIG. 10, the looper 50 is being moved forwardly. Between FIG. 8 and FIG. 10, over about 60 degrees of the cycle, the looper 50 is reciprocated quite rapidly (because of a lobe at numerals 8, 9, and 10), to shed loop 44, then release the arrested side of loop 44*a*, as needle 20 is in the vicinity of bottom dead center. Bill 64 is fully retracted in FIG. 9, and then moves rearwardly to insert the tip portion of looper bill 64 in the bight of loop 44*a*, as needle 20 begins to withdraw in FIG. 10.

Figure 11:
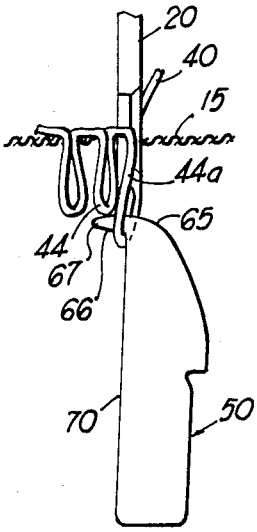
Figure 12:
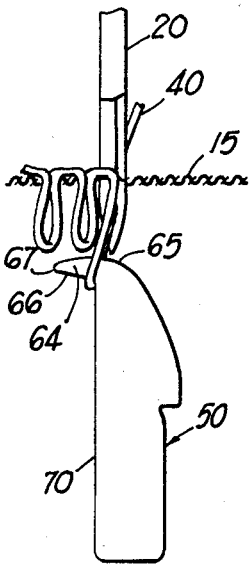
Figure 13:
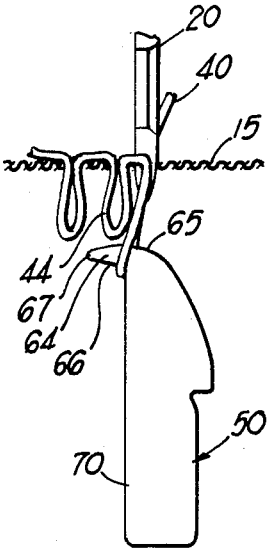
Figure 14:
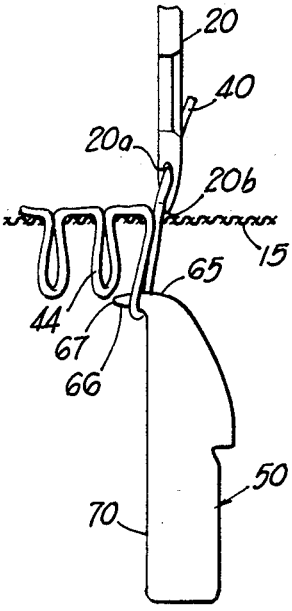

In FIG. 11, the bill 64 is moved still further rearwardly of the machine to its full protracted position with bill 64 inserted into loop 44*a* shown in FIG. 12. The bill 64 remains in its fully protracted position or rearmost position in FIGS. 13 and 14, as needle 20 is retracted. Thus, throughout a substantial part of the retraction period for needle 20, looper 50 is at dwe11 in a full protracted, rearwardly position. This same stationary or dwell position is maintained through the portions of the next cycle, depicted by FIGS. 3, 4, 5 and 6. Hence, in over one-half the cycle of the machine looper 50 is continuously stationary i.e. at dwell, and protracted, namely during a major portion of the withdrawal period for needle 20 and the entire time the needle 20 is retracted from the backing material 15 and for a period in which the needle begins its penetration to a position at which the point 20*b* is below the upper edge of the looper bill 64.

It will be obvious to those skilled in the art, that many variations may be made in the embodiment here chosen for the purpose of revealing the best mode contemplated, without departing from the scope of the invention, as defined by the claims.

We claim:

1. A method for producing a tufted product in which a backing material is moved along a prescribed path, disposing a needle with yarn therein on one side of said first path and disposing a looper on the opposite side of said first path, reciprocating said needle in a path of reciprocation for inserting successive increments of said yarn through said backing material to form successive loops as the needle is successively inserted to a prescribed depth of penetration into said backing material, the improvement comprising the steps of:

(a) reciprocating the looper in synchronization with the reciprocation of the needle for moving the bill of the looper adjacent to said path of travel of said needle for moving the tip of said bill from one side of the path of travel of said needle to the other side of the path of travel of said needle so that the tip of said bill is on said one side as the needle is approaching its fully inserted position in said backing material and so that the yarn carried by the needle is moved by the needle past a portion of the side of the looper bill without the loop of yarn being caught by the bill of the looper;

(b) thereafter, during the same period in which the loop of yarn is inserted in the backing material, moving the looper bill in an opposite direction for moving the tip of said bill from said other side of said path of travel of said needle to said one side of said path of travel of said needle;

(c) then, during the same period in which the loop of yarn is inserted in the backing material, again moving the bill of the looper from said one side of said path of travel of said needle, to said other while the loop is inserted sufficiently through the backing material that said looper bill catches and holds that loop of yarn; and (d) thereafter, releasing said loop from said bill.

2. The method defined in claim 1 wherein said loop is reciprocated from a retracted position to a protracted position once during each cycle of the machine.

3. The method defined in claim 1 wherein the looper is reciprocated once during a cycle of the machine and wherein the looper remains in a protracted position during a period in which the needle is being retracted from the backing material and during a portion of the period in which the needle is inserting a loop into the backing material.

4. The method defined in claim 1 wherein the reciprocation of the looper from its fully retracted position to its fully protracted position occurs during a period in which the needle is approaching bottom dead center and is leaving bottom dead center.

5. Tufting machine for producing a tufted product essentially free of tagging and sew through of the type having a frame, means for feeding a backing material progressively across said frame in a longitudinal direction, a needle bar on one side of said backing material, means for reciprocating the needle bar toward and away from the backing material, a plurality of needles carried by said needle bar and projecting toward said backing material, said needles respectively carrying yarns for insertion into said backing material by said needles when said needles are reciprocated, said needles being withdrawn from the backing material during portion of each cycle or reciprocation of said needle bar, a plurality of loopers associated with said needles and disposed on the other side of said backing material, said loopers having bills for movement adjacent to the paths of travel of said needles during the period in which the yarns are being inserted through the backing materials, and means for reciprocating said loopers for moving the bills of the loopers along respective paths of travel adjacent to the needles for respectively inserting the bills into the loops produced by said needles when the needles have been inserted through the backing material, and the loopers have been moved from one side of their associated needles to the other side thereof, the improvement comprising:

(a) control means for said loopers for synchronizing the movement of said needle bar with the movement of said loopers so that in each cycle tips of the bills of the loopers are on said other side as the needles move their loops of yarn toward their fully inserted position and prior to the time the bill of the loopers catch the loops, so that said needles insert the yarn along the sides of said bills without the bills projecting through the loops.

6. The tufting machine defined in claim 5 wherein said control means is an eccentric cam.

7. The tufting machine defined in claim 5 wherein said control means is an eccentric cam having a lobe over a minor portion of said cam.

8. The tufting machine defined in claim 5 wherein said loopers face rearwardly in the machine and wherein the needle in its stroke of penetrating the backing material is disposed along one side of the looper as the looper is in its most protracted position, and the loop carried by the needle is confined between the needle and the looper bill.

* * * * *